US006021750A

United States Patent [19]

Hertrich

[11] Patent Number: 6,021,750

[45] Date of Patent: Feb. 8, 2000

[54] FINGER LEVER FOR A VALVE DRIVE OF AN INTERNAL COMBUSTION PISTON ENGINE

[75] Inventor: Steffen Hertrich, Nurnberg, Germany

[73] Assignee: Ina Walzlager Schaffler oHG, Germany

[21] Appl. No.: 09/242,965

[22] PCT Filed: Jun. 13, 1997

[86] PCT No.: PCT/EP97/03088

§ 371 Date: Feb. 24, 1999

§ 102(e) Date: Feb. 24, 1999

[87] PCT Pub. No.: WO98/11327

PCT Pub. Date: Mar. 19, 1998

[30] Foreign Application Priority Data

Sep. 12, 1996 [DE] Germany ..... 196 37 069

[51] Int. Cl.[7] ..... F01L 1/18

[52] U.S. Cl. ..... 123/90.42; 123/90.44; 123/90.39; 74/559

[58] Field of Search ..... 123/90.39, 90.4, 123/90.41, 90.42, 90.44; 74/519, 559

[56] References Cited

U.S. PATENT DOCUMENTS

| | | | |
|---|---|---|---|
| 4,872,429 | 10/1989 | Anderson | 123/90.44 |
| 5,048,475 | 9/1991 | Mills | 123/90.39 |
| 5,642,693 | 7/1997 | Kotani | 123/90.41 |
| 5,720,245 | 2/1998 | Calka | 123/90.42 |

FOREIGN PATENT DOCUMENTS

| | | |
|---|---|---|
| 3929486 | 3/1990 | Germany . |
| 4305759 | 3/1994 | Germany . |
| 9401047 | 4/1994 | Germany . |
| 19543657 | 5/1997 | Germany . |

*Primary Examiner*—Weilun Lo
*Attorney, Agent, or Firm*—Bierman, Muserlian and Lucas

[57] ABSTRACT

A finger lever (1) is made as a sheet metal part without chip removal and, seen in transverse cross-section, it has a U-shaped profile opening downwards. An upper crosswall of this finger lever (1) comprises an opening (10) of essentially rectangular shape as viewed from above, a roller (3) which can be contacted by a cam (6) being arranged in the opening (10). Side walls (8 and 9) which extend downwards from the crosswall (7) receive a pin (5) which serves to mount the roller (3). Upper edges (11 and 12) of the side walls (8 and 9) have a convex shape. The rigidity of such a finger lever (1) is increased by the fact that the vertical extent of the side walls is increased to such an extent that the roller (3) is situated entirely within this vertical extent of the side walls (8 and 9).

5 Claims, 1 Drawing Sheet

FINGER LEVER FOR A VALVE DRIVE OF AN INTERNAL COMBUSTION PISTON ENGINE

FIELD OF THE INVENTION

The invention concerns a finger lever made as a sheet metal part without chip removal for a valve drive of an internal combustion piston engine, the finger lever, as seen in cross-section, having a U-shaped profile formed by an upper crosswall facing a cam and comprising, in a central region of the finger lever, an opening of essentially rectangular shape as seen in a top view, said opening receiving a roller which is in rolling contact with the periphery of the cam, the U-shaped profile being further formed by side walls which extend downwards from the crosswall and receive a pin with the roller mounted for rotation thereon, while edges of the side walls which delimit the opening have a convex shape.

BACKGROUND OF THE INVENTION

Rocker arms for the valve drive of internal combustion piston engines were generally made in the past as castings and provided with a roller mounted on a rolling bearing to reduce friction at the point of contact of the cam on the rocker arm. This structure has also been used in making finger levers out of sheet metal by cold forming without chip removal. However, problems have been encountered in such sheet metal finger levers which are relatively thin-walled, and therefore lighter and more economical than cast finger levers, because it was not possible to design them with an adequate rigidity.

A cold-formed finger lever of the generic type described above is known from DE-A 39 29 486. To rigidify this sheet metal finger lever, outwards projecting ribs are arranged on the side walls below the location of the pin. It has been determined on the one hand that these ribs do not stiffen the finger lever sufficiently and, on the other hand, said ribs increase the width of the finger lever. But since, precisely in multi-valve cylinder units only a small space is available for the finger levers arranged next to each other, the finger levers cannot be provided with such ribs.

OBJECTS OF THE INVENTION

It is an object of the invention to rigidify a finger lever made of sheet metal without chip removal without influencing the width of the finger lever.

SUMMARY OF THE INVENTION

The invention achieves this object by modifying the vertical extent of the side walls to make them so large that the roller is situated within this extent of the side walls. Thus the rigidity of the finger lever can be increased by enlarging the side walls in the direction of the cam. All the other dimensions of the finger lever remain unchanged so that this structural modification does not influence the rest of the design dimensions of the finger lever.

According to a further development of the invention, a radius of the convex edges corresponds to a radius of the roller. Thus the side walls, the apex of whose convex edges is situated in the region of a plane passing through a central longitudinal axis of the pin, end with the radius of the roller. However, it is also possible to lengthen the side walls to such an extent that a distance is obtained between said edges and the periphery of the roller situated at a lower level. In this case, the cam would have to penetrate into the rectangular opening.

According to still another feature of the invention, the surfaces of the edges adjacent to the two end faces of the roller comprise recesses. These recesses reliably prevent the cam which actuates the finger lever from coming into contact with the side walls of the finger lever due to slight axial displacements of the finger lever. A further advantage of these recesses is that splash oil can collect in them and be transferred to the end faces of the roller and thus into the rolling bearing.

As an alternative to the recesses in the side walls of the above embodiment, it is also possible to configure the side walls in a Z-shape in vertical direction in the region of the opening above the pin location. A Z-shaped configuration means that starting from their vertical extent, the side walls are at first bent into a horizontal portion and then again into a vertical portion. Due to the Z-shaped side walls, a diminishing of cross-section which would occur with the use of recesses is prevented. Although the Z-shape of the side walls results in the formation of ribs on their outer surfaces, these ribs do not present the disadvangtages of the ribs of the prior art provided at the lower edge of the finger lever. It must be taken into account, namely, that the outer surfaces of the side walls are curved in the region of the upper edges so that there is no risk, even in the case of this deformation, of having to arrange adjoining finger levers at greater distances to each other due to the ribs in the upper region of the side walls.

It is further possible to configure the recesses so that the radius at their base is larger than the radius of the edges. This gives the recesses the shape of a sickle. The same ratios can be applied to the edges of the side walls having a Z-shaped configuration.

DETAILED DESCRIPTION OF THE DRAWINGS

Figure 1:
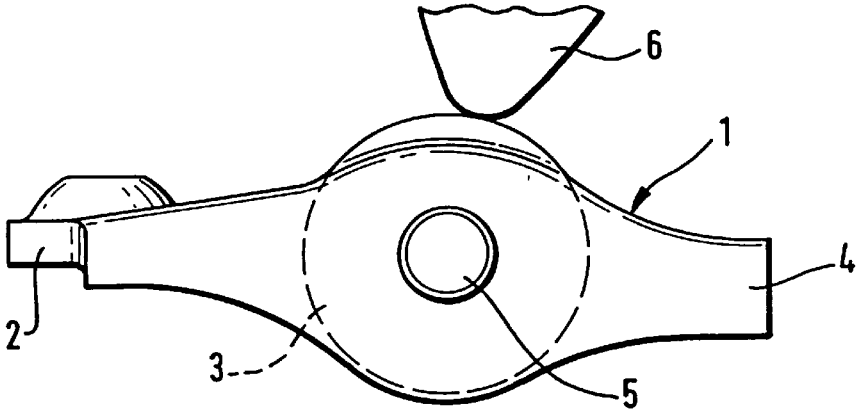
FIG. 1 is a side view of a finger lever of the invention.

A finger lever referenced at 1 in FIG. 1 can be supported at one end region 2 on a lifter post, not represented. The finger lever receives a roller 3 in a central region and acts in a second end region 4 on an end of a valve stem of a gas exchange valve, not shown. The roller 3 is rotatably mounted on a pin 5 in the finger lever 1 and contacted by a cam 6 of a camshaft. The finger lever as a whole is U-shaped, that is to say, the U-shaped profile in this preferred embodiment is open at its end away from the cam 6. It is, however, also possible to use a finger lever having a profile open in the direction of the cam 6 as shown, for example, in U.S. Pat. No. 4,796,483. The measures of rigidification which will now be described can be equally well used in a structure of a finger lever of this type.

Figure 2:
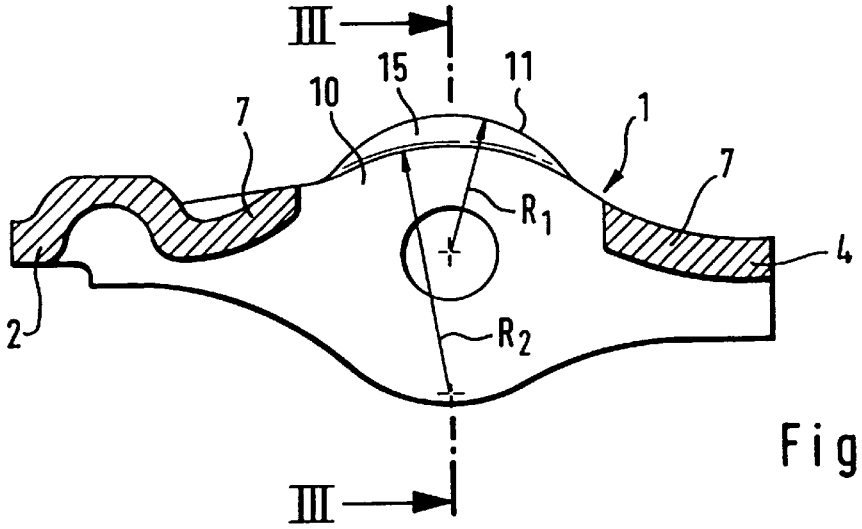
FIG. 2 is a longitudinal cross-section through the finger lever of FIG. 1.
Figure 3:
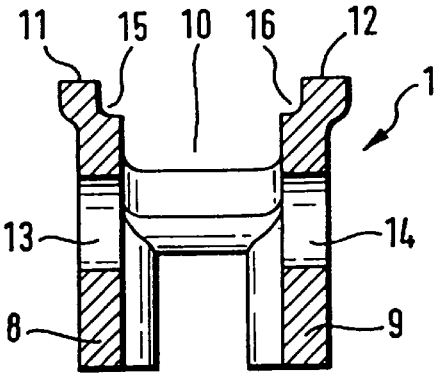
FIG. 3 is a sectional view along line III—III of FIG. 2.

In the cross-section of FIG. 2, which shows the finger lever 1 without the roller 3, it can be seen that the finger lever 1 comprises an upper crosswall 7 and side walls 8, 9 which are shown with more details in FIG. 3. In the central region of the finger lever 1, the crosswall 7 comprises a rectangular opening 10. The side walls 8 and 9 comprise edges 11 and 12 having a convex shape, and the roller 3 is mounted on the pin 5 in corresponding bores 13 and 14 of the side walls, a needle roller bearing, not shown, being disposed between the pin 5 and the roller 3.

As can already be seen in FIG. 1, the roller 3 is situated within the vertical extent of the side walls 8 and 9. This results in an advantageous rigidification of the finger lever. In the region of the edges 11 and 12, however, the side walls are deformed parallel to each other to a certain extent in outward direction so that, on the whole, a Z-shaped profile is obtained. This results in the formation of recesses 15 and 16 in the surfaces of the edges 11 and 12 facing the ends of the roller 3. As can be seen in FIG. 2, a radius $R_1$ at the edges 11 and 12 is smaller than a radius $R_2$ at the base of the recesses. Thus the recesses 15 and 16 are sickle-shaped as viewed in longitudinal cross-section. These recesses prevent the cam from coming into contact with the side walls 8 or 9 in case of an axial play in the mounting of the camshaft or in a guide of the finger lever.

Figure 4:
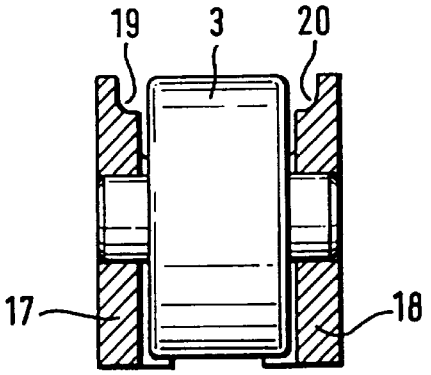
FIG. 4 is a sectional view of a further embodiment of a finger lever showing the region of a roller arranged therein.

In a further embodiment of the invention shown in FIG. 4, side walls 17 and 18 comprise recesses 19 and 20 which are formed in these side walls 19 and 20 by chipless stamping. These recesses 19 and 20 have the same function as the recesses of FIG. 3 made by the Z-shaped deformation of the finger lever.

I claim:

1. A finger lever (1) made as a sheet metal part without chip removal for a valve drive of an internal combustion piston engine, the finger lever (1), as seen in cross-section, having a U-shaped profile formed by an upper crosswall (7) facing a cam (6) and comprising, in a central region of the finger lever (1), an opening (10) of essentially rectangular shape as seen in a top view, said opening (10) receiving a roller (3) which is in rolling contact with the periphery of the cam (6), the U-shaped profile being further formed by side walls (8, 9, 17, 18) which extend downwards from the crosswall (7) and receive a pin (5) with the roller (3) mounted for rotation thereon, while edges (11, 12) of the side walls (8, 9, 17, 18) which delimit the opening (10) have a convex shape, characterized in that the roller (3) is arranged entirely within the vertical extent of the side walls (8, 9, 17, 18).

2. A finger lever according to claim 1 made as a sheet metal part without chip removal, characterized in that a radius $(R_1)$ of the convex edges (11, 12) corresponds to a radius of the roller (3).

3. A finger lever according to claim 1 made as a sheet metal part without chip removal, characterized in that recesses (15, 16, 19, 20) are provided in surfaces of the side walls (8, 9, 17, 18) which are adjacent to the edges (11, 12) and situated opposite the two end faces of the roller (3).

4. A finger lever according to claim 1 made as a sheet metal part without chip removal, characterized in that, in the region of the opening (10) above the pin arrangement, the side walls (8, 9) extend vertically in a Z-shape.

5. A finger lever according to claim 3 made as a sheet metal part without chip removal, characterized in that a radius $(R_1)$ of the edges (11, 12) is smaller than a radius $(R_2)$ at the base of the recesses (15, 16).

* * * * *